US005279139A

United States Patent [19]

Sturm

[11] Patent Number: 5,279,139

[45] Date of Patent: Jan. 18, 1994

[54] METHOD AND APPARATUS FOR ALIGNING OF HORIZONTAL ROLLS

[75] Inventor: Hans Sturm, Oberhausen, Fed. Rep. of Germany

[73] Assignee: Mannesmann Aktiengesellschaft, Dusseldorf, Fed. Rep. of Germany

[21] Appl. No.: 787,797

[22] Filed: Nov. 4, 1991

[30] Foreign Application Priority Data

Nov. 2, 1990 [DE] Fed. Rep. of Germany ..... 4035276

[51] Int. Cl.[5] ..... B21B 31/20; G01D 21/00

[52] U.S. Cl. ..... 72/21; 72/237; 33/657

[58] Field of Search ..... 72/20, 21, 35, 237, 72/238; 33/641, 644, 645, 657; 100/47, 49, 168

[56] References Cited

U.S. PATENT DOCUMENTS

| | | | |
|---|---|---|---|
| 2,054,530 | 9/1936 | Williams | 33/657 |
| 3,358,485 | 12/1967 | DeCaro et al. | 72/35 |
| 3,369,383 | 2/1968 | Barnikel | 72/237 |
| 4,127,997 | 12/1978 | Quehen | 72/21 |
| 4,312,209 | 1/1982 | Hansen | 72/237 |
| 5,052,206 | 10/1991 | Reismann et al. | 72/238 |

FOREIGN PATENT DOCUMENTS

2454896A1 8/1976 Fed. Rep. of Germany .

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A method and apparatus for aligning both upper and lower horizontal rolls in a roll stand. More particularly, it relates to a roll stand having horizontal rolls with electromechanical and hydraulic adjustments of the upper roll, and electromechanical adjustment of the lower roll, as well as position sensors associated with the adjustments. The method allows for the automatic adjusting and centering or aligning of the upper and lower horizontal rolls in a such a roll stand.

The apparatus for automatically aligning and adjusting the upper and lower horizontal rolls on a roll center plane in a roll stand comprises a housing, roll adjusting devices for upper and lower roll adjustment devices, an upper roll position sensor, an upper roll housing stop surface, fixed in position with respect to a horizontal roll center plane, a balancing means for positioning the upper roll horizontally in the housing, an upper chock having a stop surface for mating with the upper roll stop surface, a lower chock, a lower chock adjustment point, having a predetermined positional relationship to a vertex of the lower roll, and a control means for controlling the roll adjusting device for the upper roll, the roll adjusting device for the lower roll, and the balancing means.

The method comprises the steps of horizontally aligning the upper roll with the balancing means against the stop surfaces on the housing, calculating the position of the upper roll, with respect to the roll center plane, clamping the horizontally aligned upper roll against the balancing means, moving the upper roll while maintaining horizontal alignment, to a distance above the roll center plane, calculating a relative position of the lower roll with respect to the roll center plane and moving the lower roll to the calculated roll center plane, placing the upper roll on the lower roll by means of the balancing means, while measuring the distance traversed, calculating the position of the upper roll, correcting the position of the lower roll according to said calculation of the position of the upper roll; and then, nullifying the parallel upper and lower rolls with a calibration pressure of the upper roll.

2 Claims, 2 Drawing Sheets 101
move chocks against stop surfaces until mating stop surfaces have no clearance 102
calculate position of upper roll with respect to roll center plane 103
clamp upper roll against balancing cylinders 104
move upper roll down to a position above roll center plane 105
move lower roll to calculated roll center 106
place upper roll on lower roll, while measuring distance traversed, which is input into control 107
calculate change in position of upper roll from distances traversed, to produce correction values 108
correct adjustment position of lower roll 109
null parallel upper and lower rolls at roll center plane

FIG. 3

METHOD AND APPARATUS FOR ALIGNING OF HORIZONTAL ROLLS

FIELD OF THE INVENTION

The present invention relates a method and apparatus for aligning both upper and lower horizontal rolls in a roll stand. More particularly, it relates to a roll stand having horizontal rolls with electromechanical and hydraulic adjustment of the upper roll, and electromechanical adjustment of the lower roll, as well as position sensors associated with the hydraulic cylinders of the hydraulic roll adjustment, and a method for the automatic adjusting and centering or aligning of the upper and lower horizontal rolls in a such a roll stand.

BACKGROUND OF THE INVENTION

The adjusting and aligning of the upper and lower rolls of horizontal and universal roll stands is necessary, in particular, after the rolls have been changed. In this connection, it is important that the horizontal rolls be adjusted so that they are precisely aligned with the roll center plane and have a strictly parallel relationship to it. Traditionally, the adjustment was either effected manually, which is very time consuming and was dependent on the skill of the operators, or automatically, by such methods as those described, for instance, in Federal Republic of Germany DE 35 01 622 C2, incorporated herein by reference, which describes the automatic alignment of a universal roll stand.

In the method described in DE 35 01 622 C2, the lower roll is first brought to the roll center, in which connection optical detection devices may be used to determine the position of the lower roll. The upper roll is then moved at creep speed towards the lower roll, and is applied against the latter. If the two rolls are not parallel, any possible oblique orientation of the upper roll with respect to the lower roll is detected by measuring a difference in roll pressure at either end of the upper roll, by means of pressure measurement sensor modules arranged on both sides of the upper roll. The position of the upper roll is corrected on the basis of these readings.

The method of DE 35 01 622 C2 is unsuitable for precise horizontal alignment, since the position of the upper roll is oriented relative to the position of the lower roll, and is thus subject to horizontal misalignment if the lower roll has not been accurately positioned horizontally. In this way, while the method allows the automatic alignment to produce a parallel roll nip, the nip as a whole can however be inclined out of the rolling plane. From Federal Republic of Germany DE 24 54 896 A1, incorporated herein by reference, a method is known for the adjustment of a parallel, open roll nip, in which equal forces are applied by the adjustment devices onto both ends of the roll are applied. In order to balance the roll, intermediate pieces, such as shims, which cooperate with the chocks, are provided on both sides of the housing.

OBJECTS OF THE INVENTION

It is an object of the present invention to provide a roll stand with roll adjustment devices for the upper roll and roll adjustment devices for the lower roll, as well as position sensors for detecting the position of the roll adjustment devices for the upper roll, the position data detected being stored in the memory of a computer, so that a precise horizontal alignment of both upper and lower horizontal rolls is possible using substantially the existing alignment means and to provide a corresponding method for the effecting of this process of alignment and adjustment.

It is also an object of the present invention to provide an apparatus comprising a roll stand having roll adjusting devices for the upper roll and roll adjusting devices for the lower roll, as well as position sensors (distance transmitters) for detecting the position of the roll adjustment devices for the upper roll, the position data detecting system being adapted to store the position data in a storage device, such as the memory of a computer. On a roll housing of the roll stand are provided stop surfaces which are fixed in their position with respect to a horizontal housing center plane of the upper roll. The upper roll mating stop surfaces have associated with them chocks, which are present at a fixed distance from the horizontal housing center plane, by which surfaces the position of the upper roll chocks may be determined with respect to the roll housing. The chocks have balancing cylinders, which act so that the upper roll is movable vertically in a horizontal end position. The position of a vertex of the lower roll can be determined by calculation, from a known radius of the roll, and the distances from the chock center plane to the adjustment points of lower roll adjustment spindles on the chocks, as well as possibly the positions of the adjustment spindles with respect to the roll center plane.

It is a further object of the present invention to provide a method for the automatic alignment and adjustment of the upper and lower horizontal rolls with respect to the roll center plane in a roll stand, having roll adjusting devices for the upper roll and roll adjusting devices for the lower roll, as well as position sensors for detecting the position of the upper roll, the position data being stored in the memory of a computer, comprising moving, by means of balancing cylinders, the checks of the upper roll, having stop surfaces, against stop surfaces present on the housing of the roll stand, until the mating stop surfaces have no clearance, calculating the position of the upper roll with respect to the roll center plane from the geometrical determinations of the stop surfaces and the known radius of the upper roll, clamping, via adjustment cylinders, the precisely horizontally aligned upper roll against the balancing cylinders, moving the upper roll while maintaining the horizontal synchronization to a position at least 2 mm above the roll center plane, moving the lower roll to the calculated roll center, by means of the adjustment spindles, placing the upper roll, by means of its balancing cylinders, on the lower roll, the distance of movement of each adjustment cylinder being measured by means of a position sensor, and entered into the computer, calculating, in the computer, the distance moved by the upper roll, and thus the actual position of the lower roll, from the distances traveled over by the adjustment cylinders, producing correction values in the computer control so that deviations in the position of the upper roll with respect to the roll center plane can be compensated, correcting the adjustment position of the lower roll by means of adjustment spindles of the lower roll, and after correction, the parallel upper and lower rolls are nulled by compensating the force between them, as measured by the calibration pressure of the upper roll.

SUMMARY OF THE PRESENT INVENTION

A roll stand of the present invention permits, in simple and favorable manner, a precise horizontal alignment of the upper roll on the stop surfaces of the roll stand, provided for this purpose and, via the geometrically determined points and the known dimensions of the roll stand and rolls, permits an exact determination of the position of the upper roll. The present invention also provides for the alignment and adjustment of the upper and lower horizontal rolls with respect to the center of the stand.

The position sensor may be of known type, and preferably includes a hydraulic cylinder, but may also include other types, such as optical, e.g. optical scale position sensor, interferometer or parallax types, electromechanical, e.g. variable resistance type, inductive, e.g. linear variable inductance transformer type, acoustical, e.g. echo-location type, variable resistance, e.g. strain gage, etc. Examples of these are shown in Doebelin, Ernest O., *Measurement Systems Application and Design*, McGraw Hill (1975) ISBN 0-07-017336-2, Chapter 4, Motion Measurement, pp. 212–330, and Cook, Nathan H. and Rabinowicz, Ernest, *Physical Measurement and Analysis*, Addison-Wesley Pub. Co. (1963) Library of Congress Catalog Card No. 63-12469, Chapter Four, Displacement Measurement, pp. 113–152, both of which are incorporated in their entirety by reference.

The computerized control according to the present invention may be of known type, and may be combined with the controls for various aspects of the roll operation. The present computerized control preferably should be able to store a value, perform the necessary arithmetic calculations based on stored and observed variables, and output signals necessary to effect a change in the roll stand configuration. The control may be analog or digital, however, digital types are preferred. In controlling the actuators, the control may implement high order algorithms, such as Proportional-Integral-Differential (PID) control, in order to optimize the movement of the rolls. Further, the sensor inputs may be processed with both analog and/or digital filters in order to increase the signal to noise ratio and obtain a better measurement of the process variable. In addition, because the roll stand is a complex structure, various vibrations and oscillations, as well as temperature variations, etc. may be accounted for in the control algorithm. Such considerations are known to those skilled in the art, and are disclosed more fully in the following: Phillips, Charles L., Nagle, Jr., H. Troy, *Digital Control System Analysis and Design*, Prentice-Hall (1984) ISBN 0-13-212043-7; Johnson, Curtis D., *Microprocessor Based Process Control*, Prentice-Hall (1984) ISBN 0-13-580654-2; Kuo, Benjamin C. *Automatic Control Systems, Fourth Edition*, Prentice-Hall (1982) ISBN 0-13-054817-0; Deshpande, Pradeep B., Ash, Raymond H., *Elements of Computer Process Control With Advanced Control Applications* Prentice-Hall (1981) ISBN 0-13-264093-7; and Tapley, Byron D. (Ed.), *Escbach's Handbook of Engineering Fundamentals, Fourth Edition*, John Wiley & Sons (1990), which are all incorporated herein by reference.

The present invention permits an automatic alignment and adjusting of the horizontal rolls of a horizontal or universal roll stand, in such manner that the position of the upper roll is precisely definable via mechanical conditions, and the lower roll can also be horizontally aligned via the established and known position of the upper roll.

BRIEF DESCRIPTION OF THE DRAWINGS

The invention will be described in further detail below with reference to the figures shown in the drawings, in which:

FIG. 3 is a schematic flow diagram of the method of the present invention.

DETAILED DESCRIPTION OF THE PREFERRED EMBODIMENTS

Figure 1:
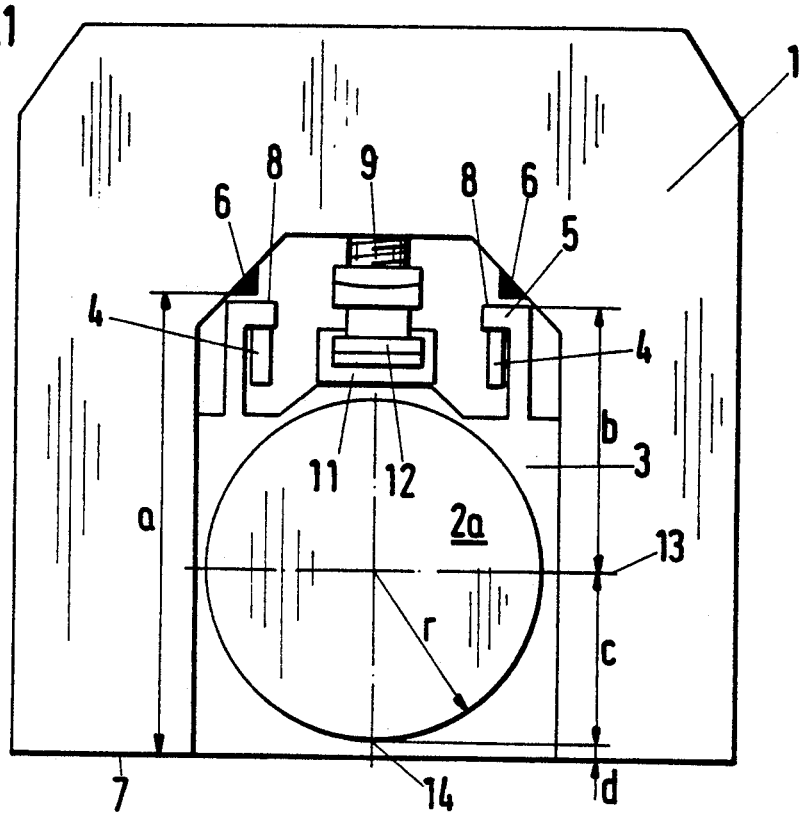
FIG. 1 shows, in greatly simplified manner, a cross section through a roll stand according to the present invention in the region of the upper roll.

Referring to FIG. 1 of the present invention, a housing 1 of a horizontal roll stand is shown in cross section, in the region of an upper roll 2*a*. The upper roll 2*a* is supported in a chock 3, which is displaceably guided in a horizontal direction in the housing 1. Balancing cylinders 4 are provided for balancing and displacing the chock 3 within the housing 1. At least two balancing cylinders 4 are provided, which engage the chock 3 behind lug-like extensions 5 of the chock 3.

At least two stop surfaces 6 are provided in the roll stand 1 which are arranged at a precisely defined distance a from the horizontal roll center plane 7. The stop surfaces 6 on either side of the roll define a plane which is precisely parallel to the roll center plane 7.

The lug-like extensions 5 of the chock 3 have, on their top portion, mating stop surfaces 8, which can be brought against the stop surfaces 6 on the housing 1, as will be described further below. The mating stop surfaces 8 of the lug-like extensions 5 of the chock 3 are coplanar.

FIG. 1 also shows the adjustment spindle 9 for one end of the upper roll 2. The adjustment spindle 9 is connected via a concave bearing 10 to a hydraulic cylinder 11, which is cup shaped, and surrounds and engages a piston 12 which is formed on the distal end of the adjustment spindle 9. The adjustment spindle 9 may be a servo-driven helical thread, for example. The hydraulic cylinder 11 and the piston 12 can be acted on by pressure from both sides, and thus, the position of the piston 12 in the cylinder 11 can be bidirectionally adjusted. The hydraulic pressure is supplied and controlled by known means, such as a pump, acting through hydraulic lines and values.

The distance b of the plane of the stop surfaces 8 from the center 13 of the chock 3 is geometrically determined and known. The radius r of the upper roll, and thus the distance c in FIG. 1 are also known. This means that with the distance a from the roll center plane to the plane of the stop surfaces 6 known, and with the sum of the distances b and c when the stop surfaces 8 and 6 rest against each other known, the position of the upper roll and of its vertex 14, and thus the distance d of the latter from the roll center plane 7, are precisely known, except with regard to wear of the roll. The actual radius of the rolls may be determined by known means, if desired.

This relationship is set forth as follows:

$$c=r \tag{1}$$

$$a=b+c+d \tag{2}$$

$$d=a-b-c \quad (3).$$

Furthermore, since the stop surfaces 6 are mechanically fixed in the horizontal plane, the exact horizontal position of the upper roll also results solely from the geometrical conditions when the stop surfaces 6 and 8 rest against each other.

Figure 2:
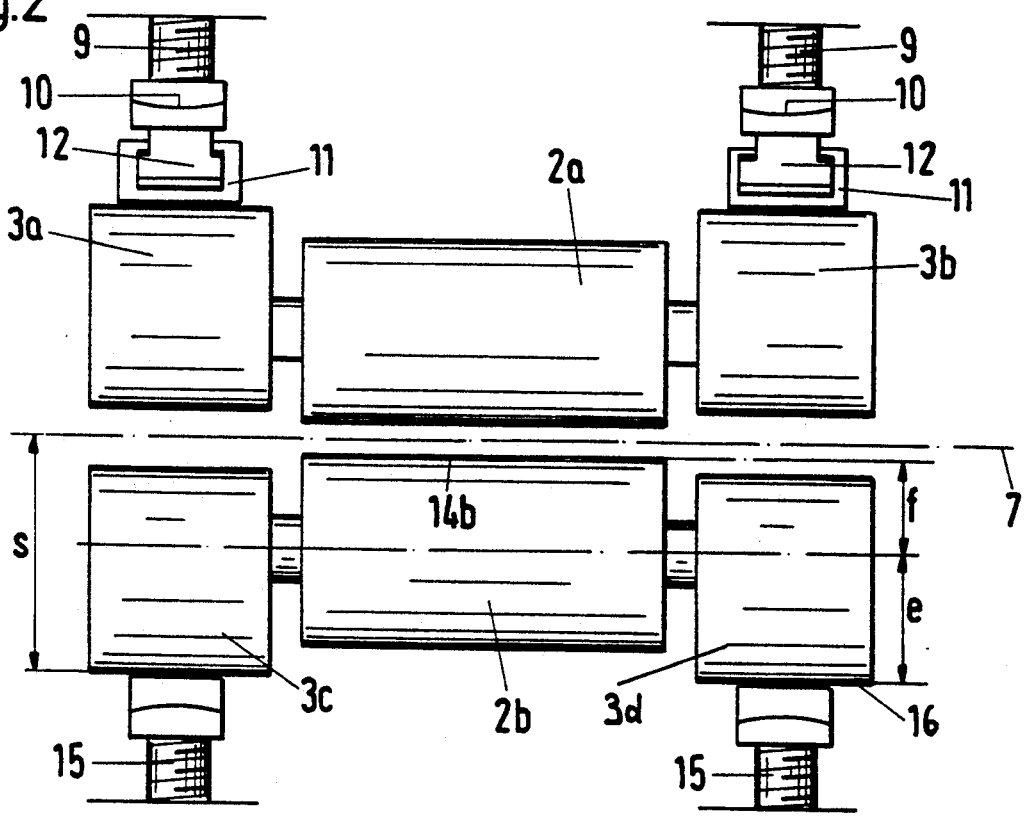
FIG. 2 is a section, 90° away, through a roll stand in accordance with the present invention.

In FIG. 2 of the present invention, the same parts bear the same designations as in FIG. 1, except that chocks 3*a*, 3*b* of the upper roll 2*a* and the chocks 3*c*, 3*d* of the lower roll 2*b* are provided, which position the rolls for rotation about their longitudinal axis in a fixed orientation. The chocks of the lower rolls 3*c* and 3*d* are precisely machined on their lower sides, the dimension e being the distance from the stop surfaces of the lower adjustment spindles 15 and adjustment surface of the chocks 16 to the center of the chocks 3*c*, 3*d*. The radius of the lower roll 2*b*, equal to the distance f, and thus the distance from the center of the chocks 3*c*, 3*d* to the vertex 14*b* of the lower roll is known. Analogous to the upper roll 2*a*, described with respect to FIG. 1, g the distance of the surface of the lower roll 2*b* from the roll center plane 7, is equal to the distance S from the stop surface 16 of the adjustment spindles 15 to the roll center plane 7, minus the distance e from the stop surfaces of the lower adjustment spindles 15 and the adjustment surfaces 16 to the center of the chocks 3*c*, 3*d*, minus the distance f, equal to the radius of the lower roll 2*b*. The radius is estimated from its nominal value, and may be measured by known means, if desired. Thus, $$g=S-e-f \quad (4).$$

The method of the present invention is shown diagrammatically in FIG. 3 of the present invention, which is a flow chart. In FIG. 3, the flow diagram shows that in the box labelled 101, the chocks 3 of the upper roll 2*a* are moved by means of the balancing cylinder 4 against the stop surfaces 6 on the housing 1 of the roll stand until the mating stop surfaces 8 are applied free of play. Thus, by means of the balancing cylinders 4, which are engaged behind the lug-like extensions 5 of the chock 3, the chock 3 is lifted so far in the housing 1 that the stop surfaces 8 on the top side of the lug-like extensions 5 rest, without play, against the stop surfaces 6 on the housing 1.

In the box labelled 102, the position of the upper roll 2*a* with respect to the roll center plane 7 is calculated from the geometrical determinations of the stop surfaces 6 and the known radius r of the upper roll. A computerized control, not shown, calculates the exact position of the upper roll 2 with respect to the stand 1 and the stop surfaces 6, and furthermore the distance d from the vertex 14 of the upper roll 2 to the roll center plane 7, from the difference between the dimension a and the sum of the measurements b and c.

In the box labelled 103, the adjustment cylinders 11 clamp upper roll 2*a* to a position which is in precise horizontally alignment, and resting against the balancing cylinder 4. Thus, via the adjustment cylinders 11 of the adjustment spindles 9, the upper roll 2, which is precisely positioned horizontally, is clamped against the balancing cylinders 4.

In the box labelled 104, the upper roll 2*a* is moved, maintaining its parallel orientation, and in synchronism, in the direction towards the roll center plane 7, to a position at least about 2 mm above the roll center plane 7 while maintaining its horizontal orientation, at which point it stops.

In the box labelled 105, the lower roll 2*b* is moved to the calculated roll center by means of the adjustment spindles 15. Thus, by means of the lower adjustment spindles 15, the lower roll 2*b* is now also moved in the direction of the roll center plane 7, the position of the vertex 14*b* of the lower roll 2*b* being known by calculation from the dimensions e and f and possibly from the position of the adjustment spindle 15.

In the box labelled 106, the upper roll 2*a* is placed, by means of its balancing cylinders 4, on the lower roll 2*b*, the distance travelled in this connection by each adjustment cylinder 11 being determined by means of a position sensor and entered into and stored by the computerized control in a memory.

In the computer, as shown on the box labelled 107, the changed position of the upper roll 2*a* and thus the actual position of the lower roll 2*b* are calculated from the stored distances traveled over by the adjustment cylinders 11. Since the known dimensions indicate merely the theoretical position of the vertex 14*b* of the lower roll 2*b*, but do not take play and wear into account, it is to be expected that the lower roll is not stopped precisely parallel and in the roll center plane 7. Deviations in the position of the upper roll 2*a* with respect to the roll center plane 7 are given by the computer as correction values to the adjustment spindles 15 of the lower roll 2*b* for the correction of their adjustment positions, as shown in the box labelled 108.

After correction, the parallel upper roll 2*a* and lower roll 2*b* are nulled, and the pressure compensated, as determined by a calibration pressure of the upper roll 2*a*, as shown in the box labelled 109. This nullification ensures that the parallel upper and lower rolls are properly aligned together at the roll center plane 7, by the calibration pressure of the upper roll.

It should be understood that the preferred embodiments and examples described herein are for illustrative purposes only and are not to be construed as limiting the scope of the present invention, which is properly delineated only in the appended claims.

What is claimed is:

1. A roll stand comprising:

a roll housing having an upper stop surface and a horizontal housing center plane in fixed relation to a roll center plane;

an upper chock movably mounted within said housing;

an upper roll rotatably mounted in said upper chock;

a balancing means for displacing said upper roll in said upper chock;

a lower chock movably mounted within said housing;

a lower roll rotatably mounted in said lower chock;

an adjusting device for adjusting a vertical position of said upper roll, by moving said upper chock;

an adjusting device for adjusting a vertical position of said lower roll, by moving said lower chock;

a position sensor for detecting said position of said upper roll and producing position data; and a control means for receiving the position data and storing said position data in a memory, and for controlling said balancing means, said upper roll adjustment means, and said lower roll adjustment means;

said upper chock having a mating stop surface adapted to mate with said upper stop surface, said mating stop surface being disposed at a predetermined distance from said horizontal housing center plane, so that when said upper stop surface and said mating stop surface are mated by said balancing means at a horizontal end position, a vertex of said lower roll is detected, on the basis of at least a radius of said lower roll, a distance from a center plane of said lower chock to a lower portion thereof and said position data from said position sensor.

2. A method for automatically aligning and adjusting an upper horizontal roll and a lower horizontal roll of a roll stand with respect to a roll center plane of the roll stand, the roll stand including a housing having stop surfaces, chocks supporting the rolls mounted in the housing, the chocks for the upper roll having stop surfaces in vertical alignment with the stop surfaces of the housing, the chocks including balancing cylinders for vertically adjusting the chocks, adjustment cylinders for vertically moving the upper roll, and adjustment spindles for vertically moving the lower roll, the adjustment cylinders including position sensors, the upper roll having a radius, the method comprising the steps of:

(a) moving the chocks of the upper roll by means of the balancing cylinders against the stop surfaces of the housing until the stop surfaces of the chocks rest against the stop surfaces of the housing without play and the upper roll assumes a precisely horizontally aligned position;

(b) calculating the position of the upper roll with respect to the roll center plane from geometrical determinations of the stop surfaces of the housing and the radius of the upper roll;

(c) clamping the upper roll in the precisely horizontally aligned position against the balancing cylinders by means of the adjustment cylinders;

(d) moving the upper roll in horizontal synchronism downwardly to a position at least two millimeters from the roll center plane;

(e) moving the lower roll to a calculated roll center plane by means of the adjustment spindles;

(f) placing the upper roll, by means of the balancing cylinders, on the lower roll, resulting in distances traversed by each adjustment cylinder, and measuring, by means of the position sensors, the distances traversed by each adjustment cylinder and inputting the distances traversed by each adjustment cylinder into a computer control;

(g) calculating in the computer control from the distances traversed by adjustment cylinder a changed position of the upper roll and thus an actual position of the lower roll, producing correction values in the computer control for determining deviations in the changed position of the upper roll with respect to the roll center plane;

(h) correcting adjustment positions of the lower roll by means of the adjustment spindles of the lower roll based on the correction values supplied by the computer control for obtaining parallel upper and lower rolls; and (i) after correction, nulling the parallel upper and lower rolls with calibration pressure of the upper roll.

* * * * *